US006041586A

United States Patent [19]

Naylor et al.

[11] Patent Number: 6,041,586

[45] Date of Patent: Mar. 28, 2000

[54] TEXTURING YARN

[75] Inventors: Geoffrey Naylor, Macclesfield; Colin Atkinson, Colne, both of United Kingdom

[73] Assignee: Rieter Scragg Limited, United Kingdom

[21] Appl. No.: 09/001,805

[22] Filed: Dec. 31, 1997

[30] Foreign Application Priority Data

Jan. 10, 1997 [GB] United Kingdom ..... 9700436

[51] Int. Cl.[7] ..... D01H 7/46

[52] U.S. Cl. ..... 57/290; 28/249; 57/284; 57/352

[58] Field of Search ..... 57/290, 352, 284; 28/249

[56] References Cited

U.S. PATENT DOCUMENTS

| | | | |
|---|---|---|---|
| 4,106,274 | 8/1978 | Eaves | 57/34 HS |
| 5,359,845 | 11/1994 | Gabalda et al. | 28/249 |
| 5,438,820 | 8/1995 | Nakahara et al. | 57/290 |
| 5,578,231 | 11/1996 | Schippers et al. | 219/388 |
| 5,671,519 | 9/1997 | Naylor | 28/249 |
| 5,715,670 | 2/1998 | Bartkowiak | 57/284 |
| 5,760,374 | 6/1998 | Schippers et al. | 57/284 |

FOREIGN PATENT DOCUMENTS

| | | | |
|---|---|---|---|
| 524111 | 1/1993 | European Pat. Off. | 57/284 |
| 280638 | 3/1990 | Japan | 57/284 |
| 1 273 272 | 5/1972 | United Kingdom . | |

*Primary Examiner*—William Stryjewski
*Attorney, Agent, or Firm*—Burns, Doane, Swecker & Mathis

[57] ABSTRACT

In a yarn false twist texturing process in which yarn is passed through heating and cooling zones to a false twist device, the yarn is passed in a helical path around a cylinder at opposed ends of which yarn guides are disposed to provide the helical path, preferably through the cooling zone. In order to raise the surge speed at which the process becomes unstable, at least one of the yarn guides is positionally adjustable relative to another guide and/or a third guide is located between the other two so as to increase the helix angle of the yarn path and the effective angle of wrap around a cylindrical cooling device on which the guides are mounted. The cooling cylinder may be a tube to which suction is applied to draw fumes from the yarn as it passes over a port in the tube and to draw ambient air into the tube to assist the cooling effect. The non-abrupt changes in direction of the yarn path allows the twist to run back through the cooling and heating zones.

19 Claims, 2 Drawing Sheets

TEXTURING YARN

FIELD OF THE INVENTION

This invention relates to the texturing of textile yarns, and in particular to the heating, cooling and false twist texturing of such yarns.

BACKGROUND OF THE INVENTION

From a production cost point of view it is advantageous to forward the yarn through the texturing machine at as high a speed as possible. This 'throughput' speed may be limited by the speed of operation of the moving parts of the apparatus, the process tension and/or the rate at which twist can be inserted into the yarn. Another limiting factor is the length of the yarn heating and cooling zones required to insert sufficient heat into the yarn for it to reach the required processing temperature, and then to cool the yarn sufficiently before its passage through the false twist device. To facilitate the twist run-back from the false twist device to the start of the heating zone, it is desirable to have a straight yarn path through the heating and cooling zones, which leads to very large machines that are ergonomically difficult to operate. A conventional yarn contact heater heats the yarn to the required processing temperature but operates at a temperature below the yarn melting temperature and only slightly above that reached by the yarn at the heater exit. To reduce the machine size problem, it is known to heat the yarn by means of a heater that operates at a temperature higher than the melting temperature of the yarn, but is considerably shorter than the abovementioned conventional heater. One of the problems associated with this process, that is exacerbated by this solution, is that of an upper limitation on the throughput speed of the yarn in the texturing machine due to instability of processing of the long lengths of insufficiently controlled yarn in the heating and cooling zones, a limitation referred to as the surge speed. An arrangement which reduces this problem, but which is not satisfactory for processing certain types and deniers of yarn, is the 'bending' of the yarn path between the heating zone and the cooling zone and/or within the cooling zone, for example as shown in U.S. Pat. No. 4,106,274 or U.S. Pat. No. 5,671,519. In these cases the yam path is subject to an abrupt change of direction within the overall length of the heating and cooling zones that is dictated by the machine configuration, and a compromise must be reached between the conflicting requirements of sufficiently high surge speed, satisfactory ergonomics and the satisfactory passage of twist through the heating zone. Any machine configuration chosen will not be satisfactory for all types and deniers of yarn. Another solution is suggested in U.S. Pat. No. 5,438,820, in which the yarn is pushed out of the generally smooth curved path through the cooling zone to give small abrupt changes of direction of the yarn path in this region. However as in the previously mentioned cases, such abrupt changes of direction are likely to inhibit the passage of twist back through the heating zone.

OBJECT OF THE INVENTION

It is an object of the invention to provide a method of, and apparatus for, increasing the surge speed for a given arrangement of yarn texturing machine, whilst readily allowing the twist to run back from the twisting device to the start of the heating zone.

SUMMARY OF THE INVENTION

The invention provides a method of texturing a textile yarn in which the yarn is heated as it travels through a heating zone, is cooled as it travels through a cooling zone, and is simultaneously false twisted, comprising forwarding the yarn through at least one of the zones in a substantially helical path between at least two yarn guides, and adjusting the helix angle of at least a part of the helical path to a predetermined angle dependent on the yarn type and denier.

Preferably the method comprises forwarding the yarn in a helical path as it is passed through the cooling zone. The adjustment may be effected by adjusting at least one of the guides positionally relative to another. Alternatively or additionally, the yarn may be passed around a third guide located between the two guides to deviate the yarn path from a regular helix between the two guides. In this case, the yarn may be forwarded in a helical path in one direction and then in a helical path in the opposite direction. The method may further comprise drawing a fluid through the cooling zone.

The method may comprise heating the yarn by passing it along a yarn path in the heating zone having a heating device operating at a temperature in excess of 200° C., and may comprise forwarding the yarn along a path which extends adjacent but out of contact with the heating device. The method may comprise forwarding the yarn substantially horizontally through the heating zone, and may also comprise forward it downwardly from the heating zone through the cooling zone towards a false twist device.

The invention also provides a yarn false twist texturing machine having a heating zone, a cooling zone and a false twist device, in which at least one of those zones comprises at least two yarn guides for guiding the yarn in a substantially helical path through that zone, wherein the helix angle of at least a part of the helical path may be adjusted to a predetermined angle dependent on the yarn type and denier.

Preferably the yarn guides are disposed within the cooling zone. One of the yarn guides may be positionally adjustable relative to another to alter of at least a part of the path. Alternatively or additionally, a third guide may be located between the two guides to deviate the yarn path from a regular helix between the two guides.

The texturing machine may comprise a cooling cylinder in the cooling zone, around which the yarn guides are disposed to provide the substantially helical path for the yarn. The position of the at least one adjustable yarn guide may be adjustable circumferentially of the cooling cylinder. The cooling cylinder may be a tube, and may have means for drawing a fluid through the tube. The texturing machine may comprise a heater in the heating zone adapted to operate at a temperature in excess of 200° C., and it may operate within the range 300° C. to 800° C. The heater may be disposed substantially horizontally, and the cooling zone may be inclined downwardly from the heating zone towards the false twist device.

BRIEF DESCRIPTION OF THE DRAWINGS

The invention will now be further described with reference to the accompanying drawings in which.

DESCRIPTION OF THE PREFERRED EMBODIMENTS

Figures 1, 2:
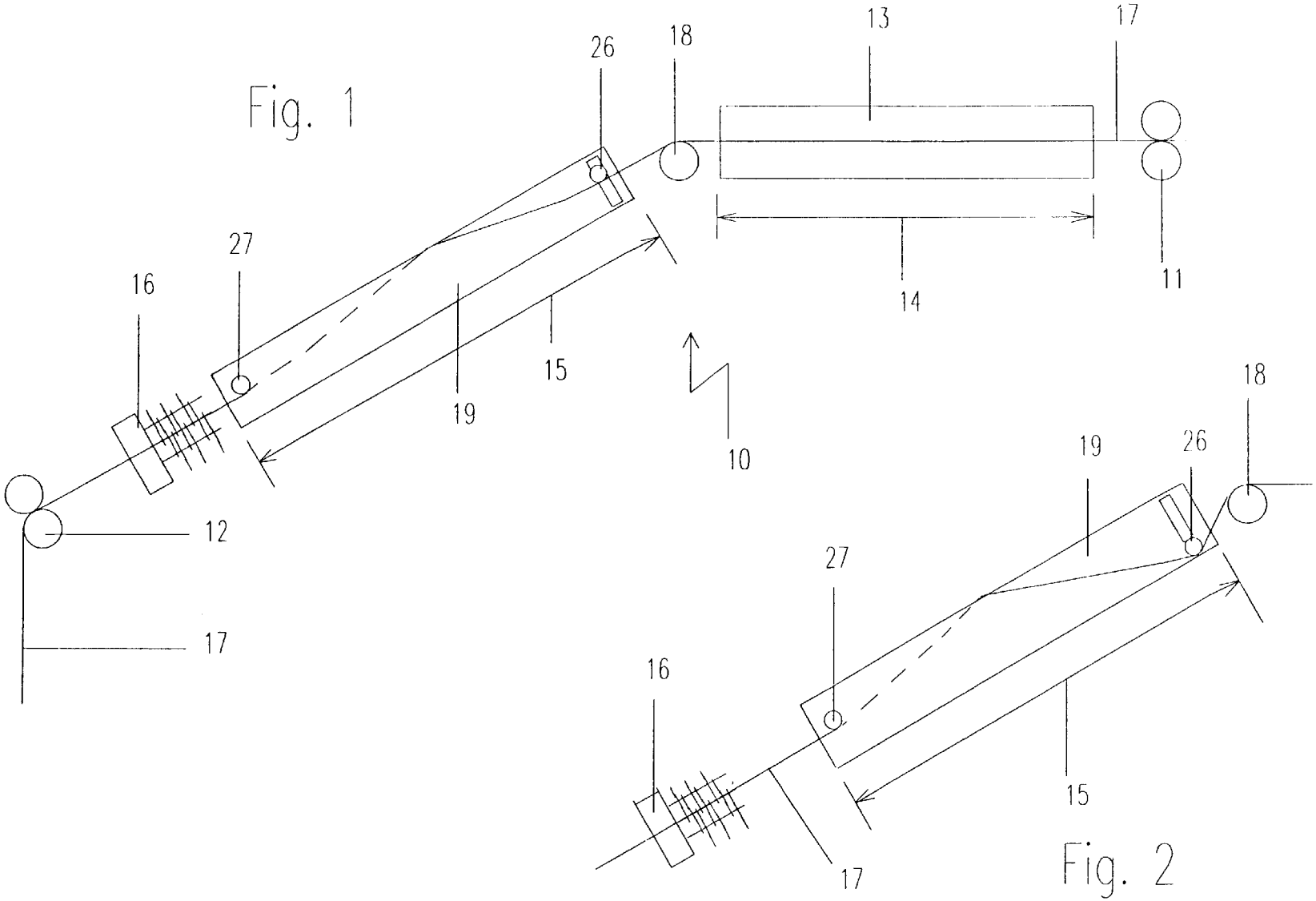
FIG. 1 shows a cooling device with a substantially helical yarn path therearound.
FIG. 2 shows the cooling device of FIG. 1 with the helix angle of the yarn path increased.

Referring now to FIG. 1, there is shown diagrammatically a yarn texturing machine 10 comprising a first feed device 11, a second feed device 12, a heater 13 co-extensive with a heating zone 14, a cooling zone 15 and a false twist device 16. A yarn guide 18 directs the yarn 17 from the heating zone 14 to the cooling zone 15. The cooling zone extends from the yarn guide 18 to the false twist device 16. The first feed device 11 is operable to withdraw the yarn 17 from a supply (not shown) and forward it to the heater 13. The second feed device 12 is operable to forward the yarn 17 to a take-up arrangement (not shown), either directly or indirectly depending on the desired condition of the textured yarn. The surface speed of the second feed device 12 may be higher than that of the first feed device 11 so as to draw the yarn 17 simultaneously with texturing it. The yarn path through the heating zone 14 is substantially straight and in this case substantially horizontal. The heater 13 of the arrangement shown is a high temperature heater operating at a temperature in the range 300° C. to 800° C., and the yarn 17 is guided by the first feed device 11 and the yarn guide 18 to pass adjacent but not in contact with the surface of the heater 13. Alternatively, the yarn guide 18 may be movable to cause the yarn 17 to contact the high temperature heater 13 only when the yarn 17 is running at its operating speed, or a much longer yarn contact heater operating at a temperature of 200° C. to 300° C. may be used.

The yarn path through the cooling zone 15, i.e. the path traversed by the yarn 17 over the majority of the yarn path through the cooling zone 15, is inclined downwardly from the heating zone 14 towards the false twist device 16, and is substantially helical. In an alternative arrangement, dependent on the type and denier of the yarn 17, the heating zone 14 may be inclined so as to be substantially in alignment with the yarn path through the cooling zone 15, in which case the yarn guide 18 may be dispensed with. The cooling zone 15 is provided with a cooling device 19. The cooling device 19 is cylindrical along the outer surface of which the yarn 17 travels, and may comprise a simple rod or tube which is of relatively small diameter compared with its length. Disposed on the cooling cylinder 19 are yarn guides 26, 27. As is shown in FIG. 1, the cooling cylinder 19 has guides 26, 27 on opposed sides and yam 17 is normally guided from guide 26 to guide 27 in a substantially helical path that makes approximately 180° angle of wrap around the surface of the cooling cylinder 19. However, as shown in FIG. 2, to attain the required twist/surge speed process speed relationship, the guide 26 is movable circumferentially around the cooling cylinder 19 so as to cause the yarn path to make an increased angle of wrap around the surface of the cooling cylinder 19. The helix angle of the yarn path, and thereby the angle of wrap of the yarn 17 around the cooling cylinder 19, may be increased in order to raise the surge speed, at which processing of the yarn 17 becomes unstable, if required. For a particular type and denier of yarn 17 being processed, the position of the yarn guide 26 may be chosen so as to raise the surge speed to the maximum possible consistent with satisfactory texturing of the yarn 17. This adjustment essentially avoids the need to change the combination of the discs of the false twist device 16 and/or the draw ratio in order to maximise the surge speed. Providing the helical path with the adjustable yarn guide 26 in the cooling zone 15 is preferred, since the partially cooled yarn 17 is better able to withstand the stresses imposed in it by the non-linear yarn path than would be the case with the hotter yarn 17 within the heating zone 14. Positioning of the movable yarn guide 26 may be effected by hand, or by a mechanical, electrical or pneumatic setting device (not shown).

Figures 3, 4:
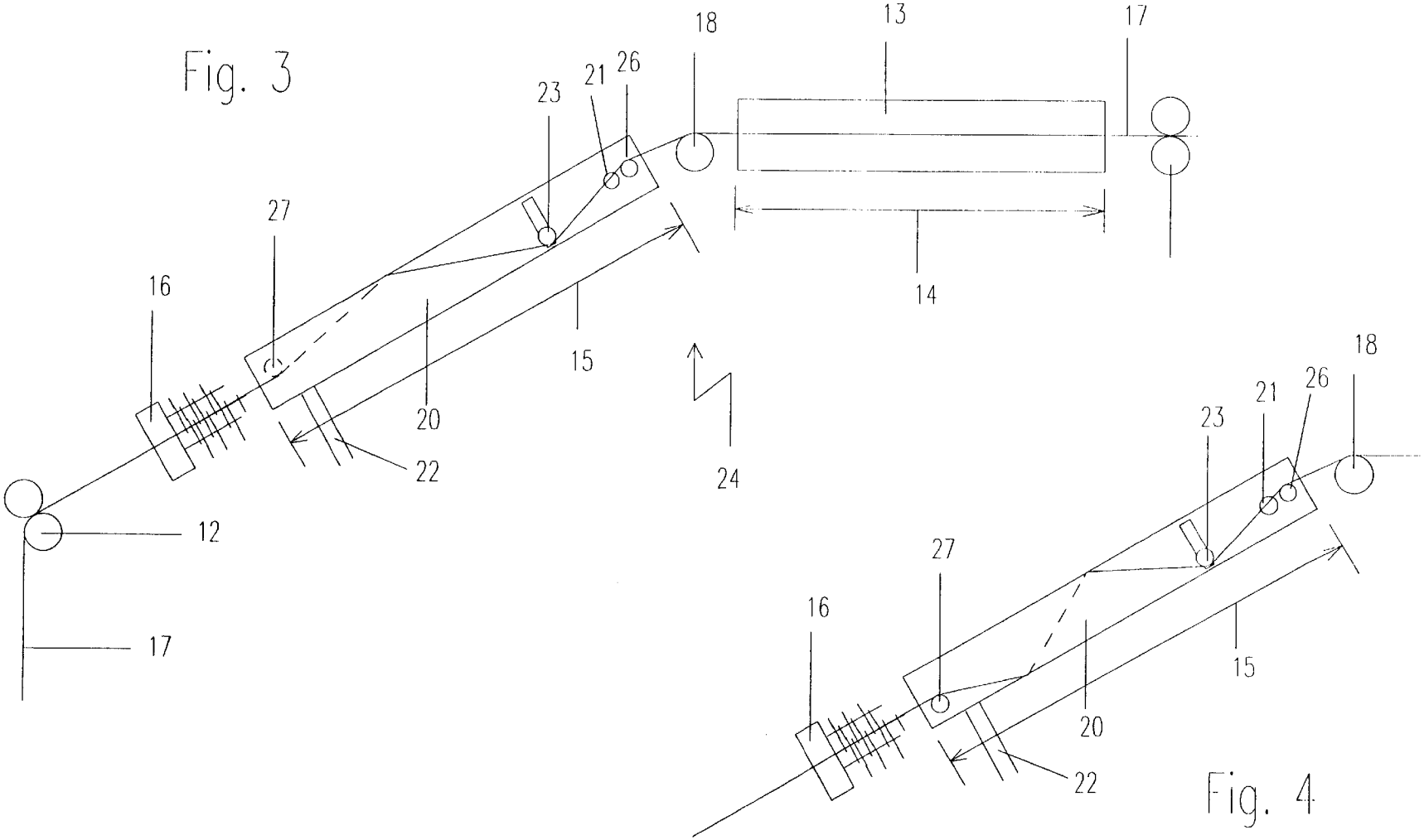
FIG. 3 shows a second embodiment.
FIG. 4 shows the embodiment of FIG. 3 with the yarn taking an alternative path.

Referring now to FIG. 3, there is shown a textile machine 24 that is generally similar to machine 10 of FIGS. 1 and 2, and corresponding parts are identified by the same reference numerals. In this case the cooling device 20 is a tube in which there is a port 21 in the yarn path and over which the yarn 17 runs. An exhaust outlet 22 is connected to a suction device (not shown) to draw fumes from the yarn 17 to waste, through the port 21 and the cooling tube 20. This suction effect may also draw ambient air into the tube 20 from the downstream end, thereby enhancing the cooling effect of the cooling tube 20. On the surface of the cooling tube 20 is a third yarn guide 23 located between the guides 26, 27. This third yarn guide may be fixed or may be movable circumferentially of the tube 20 in addition to, or instead of the yarn guide 26. For the heavier denier yarns 17 the yarn is passed directly from yarn guide 26 to yarn guide 27, the helical path being of relatively small helix angle. However for the lighter denier yarns the yarn 17 is passed from yarn guide 26 to yam guide 23 in an anti-clockwise helical path as viewed from the upstream end of the tube 20, and then in a clockwise helical path from yam guide 23 to yarn guide 27. By this means the wrap angle which the yarn 17 effectively makes around the surface of the cooling tube 20 is increased without increasing the actual angle of wrap between the yarn guides 26, 27 at the ends of the tube 20. This effect is more clearly demonstrated by the arrangement shown in FIG. 4. In this case the yarn guides 26, 27 are on the same side of the tube 20 and the yarn 17 is caused to make a full turn between the yarn guides 26, 27, i.e. an actual angle of wrap of 360° around the cooling tube 20. However with the yarn guide 23 disposed as shown, the yarn 17 makes an effective angle of wrap around the surface of the tube 20 which is much greater than 360°, for example 500°.

By means of the invention, the change of direction of the yarn 17 in the cooling zone is less abrupt than with the prior arrangements, thereby allowing the twist to pass freely through the cooling and heating zones. In consequence, the surge speed may be raised to the maximum possible consistent with satisfactory texturing of the yarn 17.

What is claimed is:

1. A method of texturing a textile yarn in which the yarn is passed through a heating zone in which it is heated, through a cooling zone in which it is cooled and then through a false twisting device to false twist the yarn simultaneously with the heating and cooling, comprising forwarding the yarn through the cooling zone in a substantially helical path having a helix angle between at least two yarn guides, moving at least one of the guides to adjust the helix angle of at least two yarn guides, and moving at least one of the guides to adjust the helix angle of at least a part of the helical path in the cooling zone dependent on the yarn type and denier.

2. A method according to claim 1, comprising passing the yarn around a cooling cylinder between the at least two yarn guides.

3. A method according to claim 2, comprising drawing a fluid through the cooling cylinder.

4. A method according to claim 1, wherein the adjustment is effected by adjusting at least one of the guides positionally relative to another.

5. A method according to claim 4, wherein the adjustment is effected by moving one of the guides circumferentially of the cooling cylinder.

6. A method according to claim 1, comprising passing the yarn around a third guide located between the two guides to deviate the yarn path from a regular helix between the two guides, and forwarding the yarn in a helical path in one direction and then in a helical path in the opposite direction.

7. A method according to claim 1, comprising heating the yarn by passing it along a yarn path in the heating zone having a heating device operating at a temperature in excess of 200° C.

8. A method according to claim 7, comprising forwarding the yarn along a path which extends adjacent but out of contact with the heating device.

9. A method according to claim 1, comprising forwarding the yarn substantially horizontally through the heating zone and downwardly from the heating zone through the cooling zone towards a false twist device.

10. A false yarn twist texturing machine having a heating zone, a cooling zone and a false twist device, in which the cooling zone comprises at least two yarn guides for guiding the yarn in a substantially helical path having a helix angle through that zone, wherein at least one of the guides is moveable whereby the helix angle of at least a part of the helical path is adjustable to a predetermined angle dependent on the yarn type and denier.

11. A yarn false twist texturing machine according to claim 10, wherein one of the yarn guides is positionally adjustable relative to another to alter at least a part of the path.

12. A yarn false twist texturing machine according to claim 10, comprising a third guide located between the two guides to deviate the yarn path from a regular helix between the two guides.

13. A yarn false twist texturing machine according to claim 10, comprising a cooling cylinder in the cooling zone and the yarn guides are disposed around the cooling cylinder to provide the substantially helical path for the yarn.

14. A yarn false twist texturing machine according to claim 13, wherein the position of the at least one yarn guide is adjustable circumferentially of the cooling cylinder.

15. A yarn false twist texturing machine according to claims 13, wherein the cooling cylinder is a tube.

16. A yarn false twist texturing machine according to claim 15, comprising suction means for drawing a fluid through the tube.

17. A yarn false twist texturing machine according to claim 10, comprising a heater in the heating zone adapted to operate at a temperature in excess of 200° C.

18. A yarn false twist texturing machine according to claim 17, wherein the heater operates within the range 300° C. to 800° C.

19. A yarn false twist texturing machine according to claim 10, wherein the heater is disposed substantially horizontally and the cooling zone is inclined downwardly from the heating zone towards the false twist device.

* * * * *